United States Patent [19]

Williams et al.

[11] Patent Number: 4,592,432

[45] Date of Patent: Jun. 3, 1986

[54] AUTOMATICALLY OPERATED BORING HEAD

[76] Inventors: Russell R. Williams, R.R. #1; Clyde W. Lestage, R.R. #1, Box 65A, both of Danville, Iowa 52623

[21] Appl. No.: 740,434

[22] Filed: Jun. 3, 1985

[51] Int. Cl.[4] ..... E21B 7/04; E21B 7/26

[52] U.S. Cl. ..... 175/26; 175/19; 175/61; 175/62; 175/73; 175/104

[58] Field of Search ..... 175/19, 26, 45, 62, 175/73, 74, 94, 104, 61

[56] References Cited

U.S. PATENT DOCUMENTS

| | | | |
|---|---|---|---|
| 2,349,033 | 5/1944 | Elliott | 175/394 |
| 3,132,701 | 5/1964 | Juntunen | 173/24 |
| 3,375,885 | 4/1968 | Scott et al. | 175/26 |
| 3,451,491 | 6/1969 | Clelland | 173/44 |
| 3,767,836 | 10/1973 | Geis et al. | 175/26 |
| 3,794,128 | 2/1974 | Gagen et al. | 175/73 |
| 3,939,926 | 2/1976 | Barnes et al. | 175/24 |
| 4,249,620 | 2/1981 | Schmidt | 175/53 |
| 4,403,664 | 9/1983 | Sullinger | 175/24 |
| 4,438,820 | 3/1984 | Gibson | 175/45 |

FOREIGN PATENT DOCUMENTS

| | | | |
|---|---|---|---|
| 991298 | 6/1976 | Canada | 175/26 |

*Primary Examiner*—James A. Leppink
*Assistant Examiner*—Hoang C. Dang
*Attorney, Agent, or Firm*—Morton S. Adler

[57] ABSTRACT

A boring head for forming a horizontal hole for a pipe installation in the subsoil beneath a roadway and the like is provided with an electrical operable guide extending forwardly from its leading end that can be selectively elevated or lowered to change the plane of forward movement of the head through the subsoil so that the location of the hole at the end of the bore can be accurately predicted. The respective movements of the guide, upwardly and downwardly, are automatically effected in response to a battery operated electronic control system designed to sense and maintain a horizontal position and to convert any sensed deviations therefrom into appropriate signals for activating and deactivating movement of the guide. The boring head is provided with a motion detecting component operably connected to the guide so that in the absence of motion in the head, the guide is rendered immobile.

10 Claims, 6 Drawing Figures

10
26
28
30
46
48
58
60
62
64
66
68
70
72
74
76
78
80
82
88
90
102
104
106
108
110
2
3

AUTOMATICALLY OPERATED BORING HEAD

BACKGROUND OF THE INVENTION

This invention relates to improvements in boring apparatus for forming horizontal holes for pipe installation beneath roadways, sidewalks, driveways and the like and includes an improved automatically operated guiding system so that the location of the hole at the end of the bore can be accurately predicted.

In laying pipelines that traverse roadways and the like, it is a common practice to provide excavated ditches, openings or pits at opposite sides of the roadway and to tunnel between the same beneath the roadway to avoid the time and expense of digging up the roadway and replacing it as exemplified in U.S. Pat. Nos. 2,349,033, 3,132,701, 3,451,491 and 4,249,620.

In such procedure, a boring head is started in one ditch to exit in the other and there is an ever present problem of maintaining a proper plane of movement of the head through the subsoil so that it will exit at the desired location in the far ditch. Addressing this problem, U.S. Pat. No. 2,349,033 provides fixed radial fins on the trailing or force receiving end of the head calculated to maintain the boring head on a line in which it is originally started but does not provide for correction for deviation from such line. In U.S. Pat. No. 3,132,701, an hydraulic cylinder is used to raise or lower the trailing end of the head to change the pitch of the bore but this is a fixed correction which must be monitored and deliberately readjusted from time to time depending upon the actual plane of movement. U.S. Pat. No. 3,451,491 provides a guide frame which can be raised or lowered at the trailing end by a screw jack and thus has the same drawbacks as the device in U.S. Pat. No. 3,132,701. In U.S. Pat. No. 4,249,620, a small pilot hole is first formed which is later enlarged and for purpose of alignment, if it is determined that the pilot hole is not properly aligned, a new one is formed. It is apparent that these prior devices for establishing a desired path of movement of a horizontal boring head have the disadvantage of being fixed adjustments that are not responsive to any deviation from the line set and must be constantly monitored on a more or less trial and error basis for continual manual adjustment and resetting from time to time as the situation may require.

SUMMARY

One of the important objects of the present invention is to provide an improved boring head for tunnelling beneath a roadway or the like for a pipe installation that includes an electronically controlled automatically operated guide mechanism for maintaining the head on a predetermined plane of movement from its entry into the subsoil beneath one side of the roadway to its exit point at the other side thereof.

In accordance with the present invention, a vertically movable guide, preferably in the form of a pair of canard stabilizers or fins on the leading end of the head are elevated or lowered to change the plane of forward movement of the head through the use of a suitable gearing assembly connected to a small direct current electric motor with reversible high torque. A battery operated electronic control system for regulating movement of the guide or stablizers includes a gyroscope that senses and maintains true horizontal positioning and adjusts for deviations therefrom and which generates signals relative to such positioning that are transferred through an amplifier to a receiver-transmitter that in turn converts the sensed information in degrees up or down into digital signals for transmission to a relay that operates the electric motor for elevating or lowering of the guide or stabilizers according to preestablished data supplied to the processing apparatus. A pressure responsive accelerometer in the head for detecting motion is operatively connected to the electric motor so that said motor will function only when the head is in motion to avoid stalling. When pressure is removed by the motive power and/or the head is static, the accelerometer is deactivated.

The foregoing objects and such further objects as may appear herein, or be hereinafter pointed out, together with the advantages of this invention will be more fully discussed and developed in the more detailed description of the accompanying drawings.

DESCRIPTION OF THE PREFERRED EMBODIMENTS

Figures 1, 2, 5:
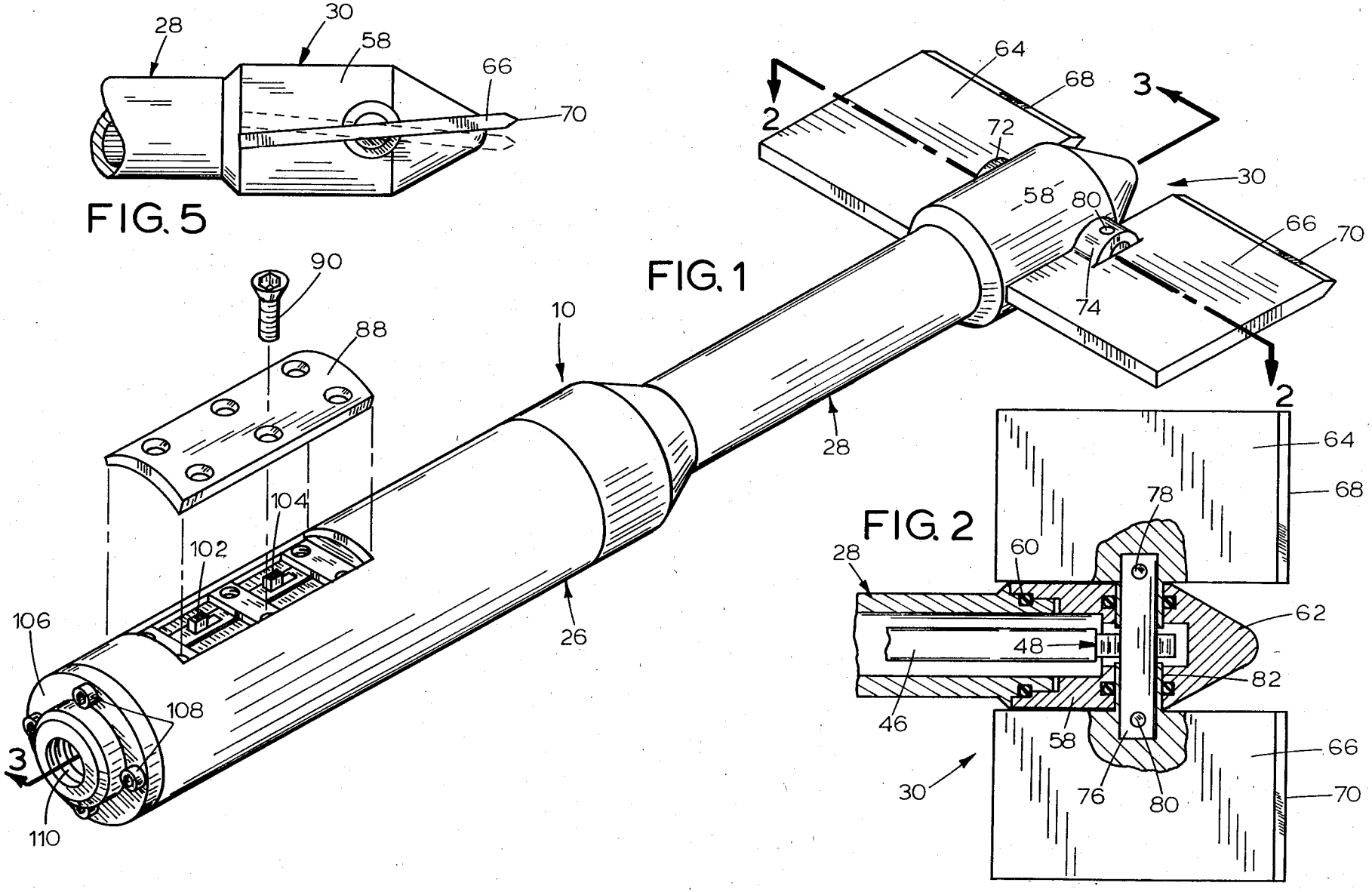
FIG. 1 is a perspective view of the new guided boring head in this invention with a cover plate over switch components shown in exploded position.
FIG. 2 is a view from the line 2—2 of FIG. 1 and partially in section showing the guide or stabilizers at the leading end of the boring head.
FIG. 5 is a side elevational view of the leading end of the boring head showing the guide or stabilizers in an upwardly pitch in solid lines and in a downwardly pitch in broken lines.
Figure 6:
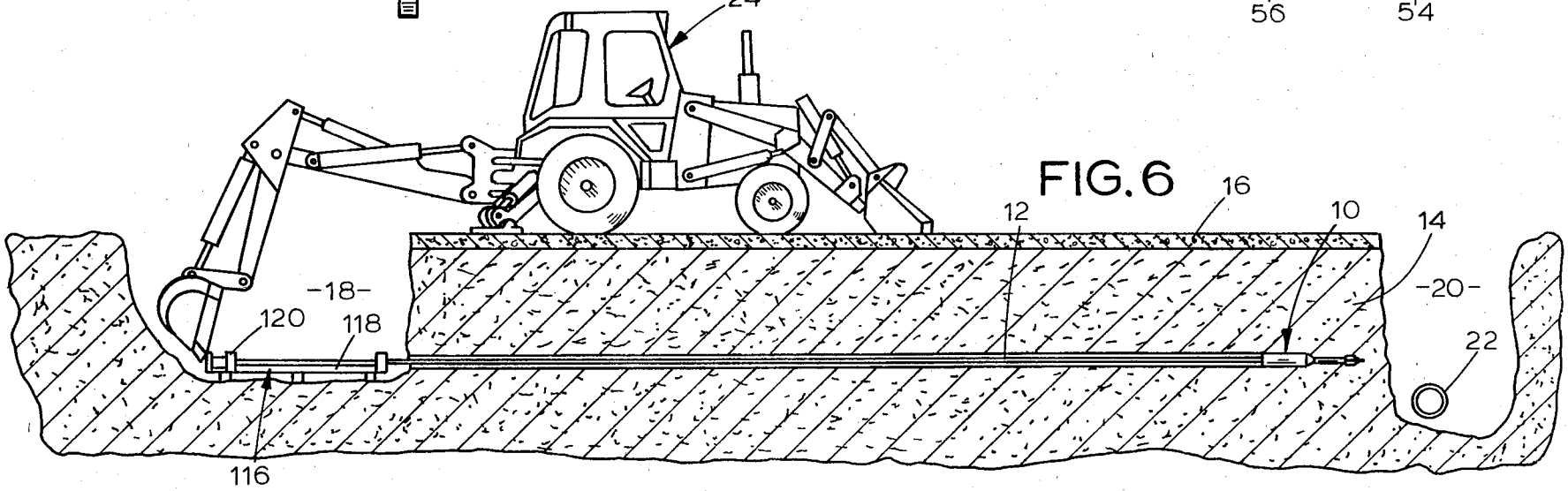
FIG. 6 is a side schematic view of a roadway with ditches at opposite sides and this boring head disposed for boring a hole beneath the roadway and propelled by a source of power represented by a backhoe.

Referring to the drawings, the new guided boring head assembly of this invention is designated generally by the numeral 10 as best seen in FIG. 1. The environment for which head assembly 10 is particularly designed is illustrated in FIG. 6 where assembly 10 is shown attached to pusher rods 12 for forming a horizontal hole through the subsoil 14 beneath a roadway 16 between ditches or pits, 18, 20 at opposite sides of the roadway 16. In laying pipelines that traverse roadways and the like, it is a common practice to form a hole between ditches 18, 20 to avoid the time and expense of tearing up and replacing the roadway in order to provide a connection to a pipe 22 laid in one ditch such as 20. Various sources of power have been used for pushing or driving a boring head through the subsoil such as bulldozers, requiring a larger ditch, hydraulic rams and as shown in FIG. 6, a backhoe 24 which we preferably use since such equipment is usually present at the work site and thus no special or additional equipment is necessary or has to be brought in.

Assembly 10 is designed to overcome the disadvantages of prior hole boring devices discussed above relative to maintaining an accurate plane of horizontal movement of the boring head and, as will be described in detail, is provided with an automatically operable guiding mechanism for maintaining a predetermined plane of movement through the subsoil so that the location of the hole at the end of the bore can be accurately predicted and be positioned at a desired location.

Assembly 10 comprises generally a respective rear and forward housing section 26, 28 with section 28 being concentrically reduced relative to section 26 and a guidable boring head section 30 operably secured to section 28 as shown.

Within the forward portion of housing 26, there is suitably mounted a small twelve volt direct current 1/200 horsepower electric motor 32 with reversible high torque calibrated to rotate three degrees per second and operably connected through the gear reduction unit 34 to shaft 36 that extends into section 28 and is secured by pin 38 to the externally threaded collar 40. An internally threaded coupling 42 operably engages collar 40 and the externally threaded end 44 of rod 46 that is axially aligned with shaft 36 as best seen in FIG. 4. Rod 46 extends forwardly to a point 48 within head section 30 as best seen in FIG. 2 where leg portion 50 extends downwardly into chamber 52 of section 30 (FIG. 3) and is suitably secured to the horizontally disposed toothed rack or plate 54 as by a pin 56 (FIG. 4). Thus far described, it will be understood that as motor 32 rotates shaft 36, collar 40 and coupling 42 will move horizontally either rearwardly or forwardly depending upon the direction of rotation of shaft 36 and collar 40 and correspondingly move rod 46 and plate 54 either rearwardly or forwardly for purposes that will later be described in more detail.

Figure 3:
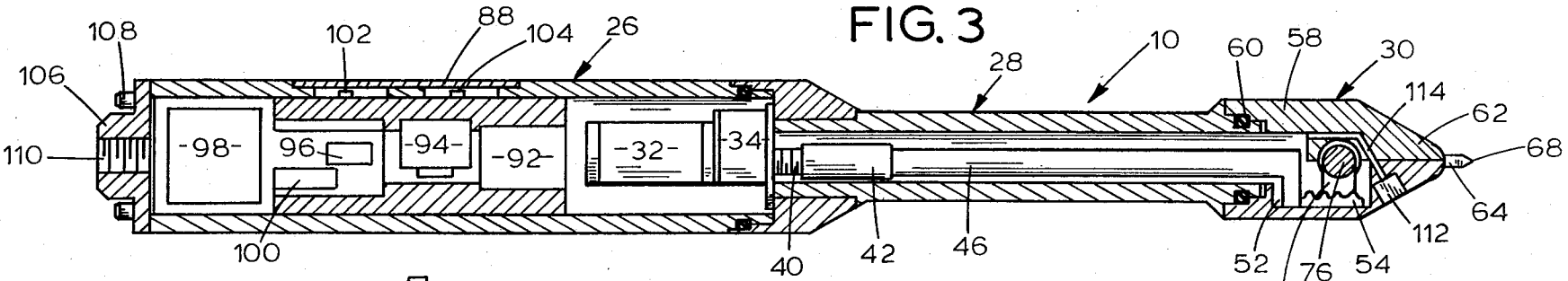
FIG. 3 is a longitudinal sectional view taken on the line 3—3 of FIG. 1.
Figure 4:
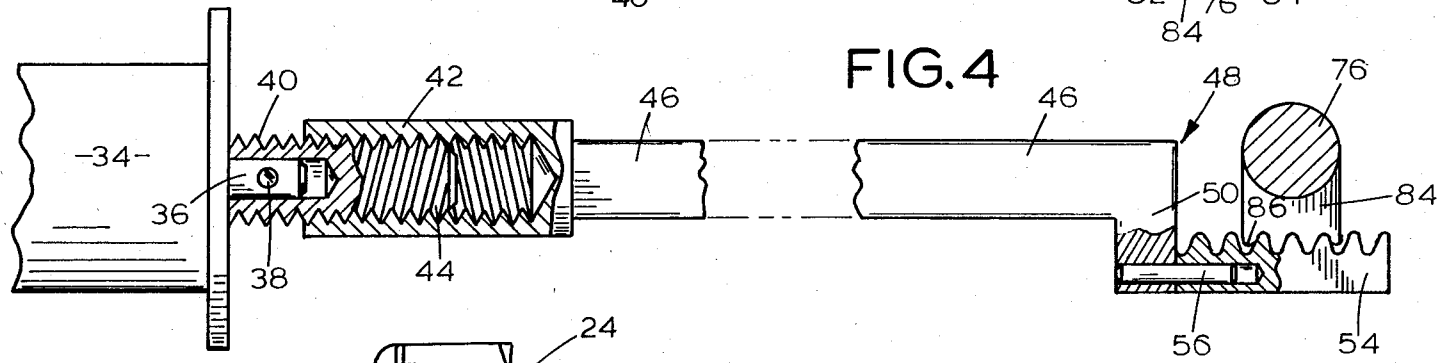
FIG. 4 is an enlarged fragmentary fore-shortened view to show details of the threaded coupling and the gearing associated with the guide or stabilizers represented in FIG. 3.

The boring head section 30 is one of the important novel features of this invention and comprises a cylindrical body 58 suitably secured to the forward end of section 28 and includes O-ring seals 60 as seen in FIGS. 2,3 and is provided with a cone shaped leading end 62. At opposite sides of body 58 are like canard stabilizers or fins 64, 66 each having respective bevelled leading edges 68, 70. The canards 64, 66, on facing sides, are provided with integral annular sockets or wells 72, 74 that embrace opposite ends of a shaft 76 (FIG. 2) which extends through body 58 and are secured to said ends by the respective pins 78, 80. Shaft 76 is supported in suitable bearings 82 for limited movement about its longitudinal axis and is provided with a depending rocker member 84 having a lower arcuate toothed edge 86 for meshing engagement with plate 51 as best seen in FIG. 4. By this arrangement, it will be appreciated that as plate 54 is moved back and forth, shaft 76 will be rocked so that canards 64, 66 are tilted upwardly or downwardly as illustrated in FIG. 5 whereby an accurate horizontal plane of movement through the subsoil can be maintained for determining the location of the hole at the end of the bore.

An automatic control system for operating the canards 64, 66 is another important feature of this invention and this is accomplished by what we refer to as an electronic package located in housing 26 which comprises respective components that are all commercially available for inter-connection for the purposes intended and for which no invention, per se, is being claimed except as relates to the combination and arrangement as will appear.

With reference more particularly to FIG. 3, the interior of housing section 26 can be accessed by the removable cover 88 secured by screws 90 and there is mounted within housing section 26, a pitch gyroscope 92, an amplifier 91, a receiver-transmitter 96, a battery power pack having five and twelve volt connections 98, a relay 100 and two switches 102, 104. The rear end of section 26 is provided with a removable cap 106 secured by stud screws 108 for easy installation and replacement of the battery pack 98. Cap 106 also has coupling means 110 for the pusher rod 12 as will be later referred to.

The gyroscope 92 is the sensing element of this control system for sensing and regulating the horizontal position of assembly 10 and is available in a form programmed to provide information as to any change in horizontal position, up or down, through the amplifier 94 to the receiver-transmitter 96 which in turn is programmed to process such information in degrees up or down into digital signals to the relay 100. The motor 32 is connected through switch 102 to the battery pack 98 and the relay 100 with information from the receiver-transmitter 96 controls the up/down and on/off phases of motor 32 whereby rod 46 is moved forwardly with an up signal and rearwardly with a down signal as described and the movement of the canards 64, 66 are controlled accordingly. Such movement of the canards 64, 66 need not exceed five degrees. Switch 104 connects the components other than motor 32 to the battery pack 98 for five volt operation.

Because of the small capacity motor 32, movement of the canards 61, 66 in a static position could result in stalling and this is avoided by use of an accelerometer 112 in the boring head 30 (FIG. 3) from which a wire (not shown) extends through tubing 114 to the circuit of the motor 32. Accelerometer 112 is also a standard piece of equipment used because it is pressure responsive and when no pressure is present such as when assembly 10 is static, the circuit to motor 32 is open so motor 32 cannot operate and will not operate until assembly 10 is in motion to provide pressure on accelerometer 112 for closing the motor circuit. This is, of course, merely a safety factor and does not otherwise affect the operation of the canards. As indicated above, all of the electric and electronic components of this control system within housing 26 and including the accelerometer 112 are commercially available for the purposes described together with all necessary interconnecting wires and plugs.

With reference to FIG. 6, assembly 10 is shown for forming a horizontal hole beneath roadway 16 from ditch 18 to ditch 20. For this purpose, a suitable grade plate 116 is placed in ditch 18 at the desired grade level and is provided with a pair of spaced guide rails 118 for which only one is shown, having a longitudinal axis parallel to the intended axis of the hole. Assembly 10 is positioned on the grade plate 116 with the cone end 62 disposed for entering the subsoil 14. One end of a pusher rod section 12 is suitably secured to coupling 110 at the rear end of assembly 10 and the other end of such rod is suitably secured to a pusher head 120 designed for movement in engagement with rails 118. The pushing force against head 120 is provided, preferably, by the backhoe 24 in a well known manner and as head 120 and assembly 10 move through the subsoil for the length of each rod section 12, additional sections 12 can be added as required.

Once the hole has been completed and assembly 10 has entered ditch 20, assembly 10 can be removed from the pusher rod 12 whereby as rods 12 are being withdrawn, any pipe (not shown) to be placed in the hole just formed, can be coupled to rod 12 in any well known manner to be pulled through the hole. Accordingly, in view of the foregoing, it is thought a full understanding of the construction and operation of this invention will be had and the advantages of the same will be appreciated.

We claim:

1. A boring head assembly for automatically maintaining a horizontal plane while forming a hole for a pipe installation through the subsoil beneath a roadway and the like, comprising:

an elongated cylindrical housing having a leading and trailing end adapted to be pushed or driven through the subsoil, a boring head removably secured to said leading end, a shaft disposed through said boring head transversely of the longitudinal axis of said housing, a pair of canard stabilizers disposed respectively at opposite sides of said boring head and each secured to a respective end of said shaft, rocker means in said boring head for effecting limited movement of said shaft in respective opposite directions about its longitudinal axis, electrically operably means in said housing operatively connected to said rocker means whereby movement of said rocker means correspondingly moves said canard stabilizers to and away from a horizontal plane, a battery operated switch controlled electronic circuit in said housing, comprising:

a relay operably connected to said electrically operable means, means for sensing the horizontal position and any deviations therefrom of said housing and for transmitting signals relative thereto, means for receiving and amplifying said signals, and means for receiving said amplified signals and converting the same in degrees up and down into digital signals and transmitting the same to said relay for effecting selective upwardly and downwardly movement of said canard stabilizers.

2. An assembly as defined in claim 1 wherein said electrically operable means is a 1/200 horsepower direct current electric motor with reversible high torque.

3. An assembly as defined in claim 1 wherein said means for sensing the horizontal position of said housing is a gyroscope.

4. An assembly as defined in claim 1 including means on said boring head responsive to motion thereof and operably connected to said electrically operable means whereby in the absence of motion of said boring head, said canard stabilizers are rendered immobile.

5. An assembly as defined in claim 4 wherein said means responsive to motion is a pressure responsive accelerometer.

6. A boring head assembly for automatically maintaining a horizontal plane while forming a hole for a pipe installation through the subsoil beneath a roadway and the like, comprising:

an elongated cylindrical housing having a leading and trailing end and adapted to be pushed or driven through the subsoil, a boring head removably secured to said leading end, a shaft disposed through said boring head transversely of the longitudinal axis of said housing, a pair of canard stabilizers disposed respectively at opposite sides of said boring head and each secured to a respective end of said shaft, a direct current electric motor with reversible high torque-mounted in said housing, a motor shaft on said electric motor extending towards said leading end, an elongated rod disposed in said housing in axial alignment with said motor shaft, one end of said rod being in spaced relationship to said motor shaft and the other end extending into said boring head, a threaded coupling operably engaged with said motor shaft and said one end of said rod whereby rotation of said motor shaft in one direction effects the rearward movement of said rod and rotation of said motor shaft in the opposite direction effects the forward movement of said rod, a rocker member assembly disposed in said boring head and operably connected to said rod for forward and rearward movement therewith and to said shaft in said boring head for effecting limited movement thereof in respective opposite directions about its longitudinal axis whereby movement of said rocker member in respective opposite directions acts to correspondingly move said canard stabilizers to and away from a horizontal plane, a battery operated switch controlled electronic circuit in said housing comprising:

a relay operably connected to said electric motor, means for sensing the horizontal position and any deviations therefrom of said housing and for transmitting signals relative thereto, means for receiving and amplifying said signals, and means for receiving said amplified signals and converting the same in degrees up and down into digital signals and transmitting the same to said relay for effecting operation of said electric motor to move said rod and rocker member in a direction dictated by said signals and correspondingly move said canard stabilizers.

7. An assembly as defined in claim 6 wherein said rocker member assembly includes:

a toothed rack disposed in said boring head and operably connected to said rod for forward and rearward movement therewith, and said shaft in said boring head provided with a depending rocker member having a lower arcuate toothed end in meshing engagement with said toothed rack whereby movement of said toothed rack acts to rock said shaft in said boring head and correspondingly effect the movement of said canard stabilizers.

8. An assembly as defined in claim 6 wherein said electric motor is 1/200 horsepower.

9. An assembly as defined in claim 6 including means on said boring head responsive to motion thereof and operably connected to said electric motor whereby in the absence of motion of said boring head, said electric motor is rendered inoperative.

10. An assembly as defined in claim 9 wnerein said means responsive to motion is a pressure responsive accelerometer.

* * * * *